US005200245A

United States Patent [19]

Brodrick, Jr.

[11] Patent Number: 5,200,245

[45] Date of Patent: Apr. 6, 1993

[54] FASTENER

[76] Inventor: Louis T. Brodrick, Jr., 110 Brodrick La., Hot Springs, Ark. 71901

[21] Appl. No.: 782,607

[22] Filed: Oct. 25, 1991

[51] Int. Cl.[5] ..... A44B 11/25; B32B 3/06; B32B 23/02; B32B 7/12

[52] U.S. Cl. ..... 428/100; 428/103; 428/192; 428/194; 428/343; 2/DIG. 6; 24/304; 24/306

[58] Field of Search ..... 428/100, 103, 343, 354, 428/192, 194; 24/16 R, 304, 306, 442; 2/DIG. 6

[56] References Cited

U.S. PATENT DOCUMENTS

| | | | |
|---|---|---|---|
| 3,370,818 | 2/1968 | Pevi | 428/100 |
| 4,726,975 | 3/1988 | Hatch | 428/100 |
| 4,784,890 | 11/1988 | Black | 428/100 |
| 4,881,997 | 11/1989 | Hatch | 428/100 |
| 4,963,410 | 10/1990 | Bryant | 428/100 |

*Primary Examiner*—George F. Lesmes
*Assistant Examiner*—Kathryne J. Shelborne

[57] ABSTRACT

A fastener consisting of two layers of hook-and-loop materials combined into a fastener for use, either with coils of elongated materials, or, alternatively, for releasably securing any objects together, one or two of which are permanently affixed to the fastener.

1 Claim, 9 Drawing Sheets

FASTENER

BACKGROUND OF THE INVENTION

1. Field of the Invention

The invention relates to fasteners.

2. Background

Coiling and securing a wire or cord has so far presented a problem, in that methods available have been cumbersome, unreliable, time consuming, often involving a search for a suitable fastener. The invention described here not only represents an improved method to solve these problems, but has also proved to be a solution to a number of problems of temporarily fastening various objects to each other, as well as permanently securing suitable objects to each other to avoid loss or search.

In prior art, U.S. Pat. No. 4,963,410 refers to a fastener, that uses hook-and-loop materials and a cinch ring, to produce a releasable and reusable fastener mechanism. It differs in several important ways from the fastener here described: (1) It is of different composition and construction, and includes, a.o., a cinch ring as an essential part; (2) In one variant the loop tape is threaded through the cinch ring, folded back onto itself and sewed together; (3) The fastener is said to be preferably 1 in. wide.

Similarly, U.S. Pat. No. 3,000,384 describes a hook-and-loop type fastener with a cinch ring, intended particularly for women in encircling a hank or lock of hair, such as in a pony tail.

It is characteristic of these prior fasteners that they include a cinch ring to make it possible to wind the fastener back onto itself in such a way that the hook and loop surfaces attach to each other. As a consequence of the use of a cinch ring, such fasteners are not permanently attached, but can be removed and reused. While this latter characteristic may be an advantage in some cases, it is not so in others. On electric hand tools with a wire cord, e.g., especially when used professionally, it is a distinct advantage to have the fastener permanently in place for securing the coiled cord.

The present invention uses only two elements, both of hook-and-loop type materials, including pressure-sensitive adhesive, simplifying assembly and reducing cost.

Furthermore, the avoidance of any additional member, such as a cinch ring, reduces the bulk of the fastener, both before attachment and in use, which is of advantage, in packaging, shipping and storing, and especially when in use, e.g. on a hand tool.

As another important difference from previous art the fastener described here is designed to remain permanently fixed in place after application, fixed by the adhesive backing. Apart from keeping the fastener permanently in place, this feature serves another important function by making it possible to double the fastener back onto itself for adherence between the hook and the loop surfaces, in effect substituting this function of the cinch rings used in prior art.

For many uses, it is a significant advantage to have the fastener permanently fixed in place, readily available for reuse, e.g. around the wire of a handtool, while at the same time not hindering operation.

The fastener described here, because of its simple construction, can be manufactured in many different widths, from as little as about ¼ in. up to several inches for heavy objects.

Furthermore, the fastener described here as a second embodiment of the invention is intended for use in a way not possible with the prior art fasteners.

SUMMARY OF THE INVENTION

It is an object of the invention to provide an improved fastener for use with elongated materials, such as wires, cords, ropes, or hoses, etc., to releasably secure such material into a bunch that can easily be opened and rewound as required.

It is a further object to provide a fastener for objects of any suitable kind, to which the fastener strip can be affixed, so as to releasably secure any object onto other material, around or through which the fastener strip can be wound.

It is also an object of the invention to provide a fastener, which can be permanently affixed to two separate objects, while providing a means of releasably securing them tightly to each other.

Still further, it is an object to reach these objectives in a way that will require a minimum of time, effort, and cost.

DETAILED DESCRIPTION OF THE DRAWINGS

The fasteners, according to this invention, are manufactured of hook-and-loop materials, a characteristic of which is that when the active (front) surfaces of one piece of each type are pressed together, they will releasably adhere to each other. A common trade name for such materials is Velcro(TM). The fasteners are produced by cutting material to size and joining it back to back in such a way, that one surface of the completed fastener consists of loop type material, and the other of the hook type.

One of these materials, or both, will at least partly be provided with an adhesive backing. The two layers will be cut and assembled so that when they are joined back to back to form a fastener, one or both of them, with adhesive backing, will protrude, and will serve to permanently affix the fastener to one or two objects. The adhesive layer of the protruding end(s) may be applied after joining the two layers, especially when the layers are joined by other means than adhesives, e.g. by sewing or by heat-sealing.

There is great versatility in adapting the fasteners to various needs with respect to the forces exerted on them, especially by varying the type of hook-and-loop material used, as well as the widths of the fasteners. Likewise, the lengths of the fasteners can be adapted to a wide variety of needs, including the lengths of the protruding ends with adhesive backing. These protruding ends may or may not be protected by a detachable piece of material to be removed before applying the fastener.

A fastener will normally be put to use by fixing the pressure-sensitive adhesive end onto or around an object to be fastened.

As an example, on a hand-tool with an electric cord, the fastener may be fixed around the cord, at any preferred spot. After coiling the cord, the fastener is wound around the bunch and secured onto itself.

In another type of use an object may be secured, not to another part of itself, but to a separate object of similar or dissimilar nature.

In the case of fasteners with two adhesive, single-layered ends, they are used by affixing the two ends to separate objects, thus permanently joining them. In order to secure the objects tightly to each other, the fastener is wound around itself so that the hook and loop surfaces adhere releasably.

Figure 1:
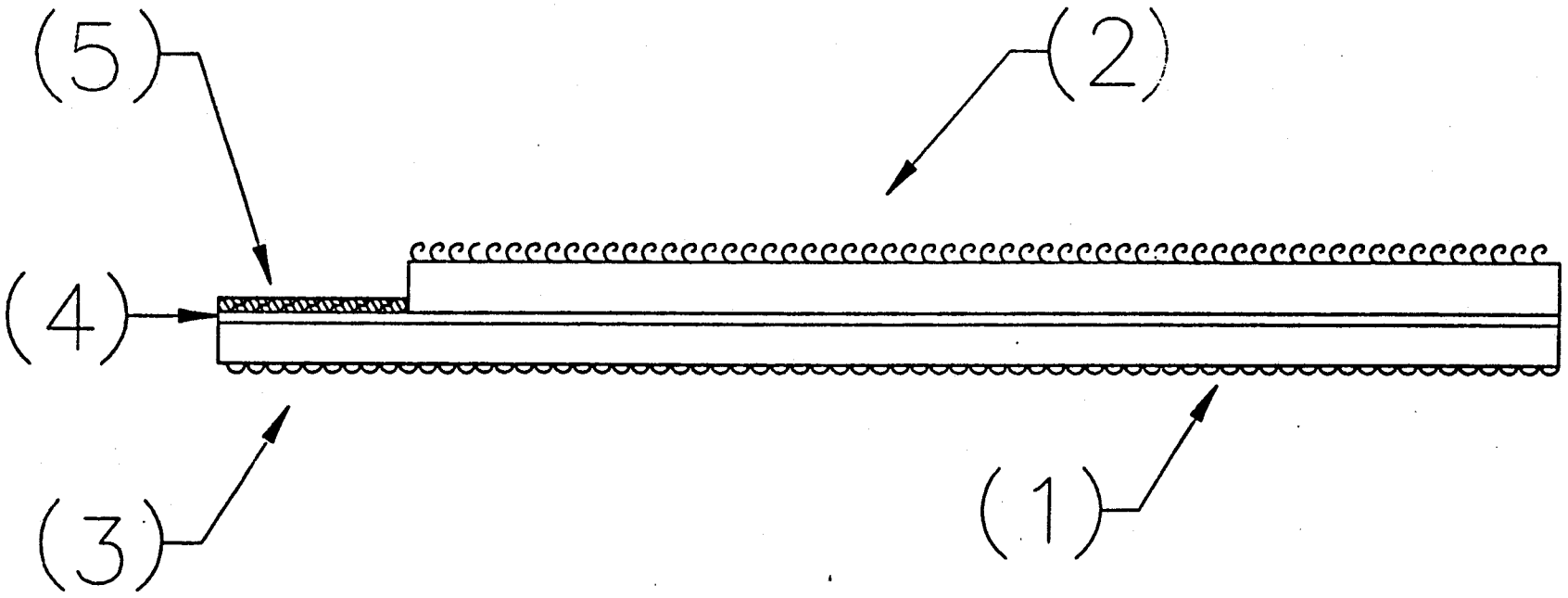
FIG. 1 illustrates a preferred embodiment of the invention.

FIG. 1 shows a fastener according to a preferred embodiment of the invention, consisting of two layers, one hook (2), and one loop (1) layer, permanently joined together back to back, with one end consisting of a single protruding layer, which can be of either type. The two layers can be joined together either by one or two adhesive layers applied to the back of one or both types of fastener members(4), by sewing the layers together, or by any other single or combination of suitable means. The protruding, single-layered part(3) of the fastener, which can be either of the look or hook type, has a pressure-sensitive, adhesive layer(4) on its back side, serving to permanently affix the fastener to an object, which is to be secured to another part of itself, or to another object. For protection before use, this adhesive surface(4) may be covered with a strip of paper, plastic, or other suitable material(5), to be removed before fixing the fastener in place.

Figure 2A:
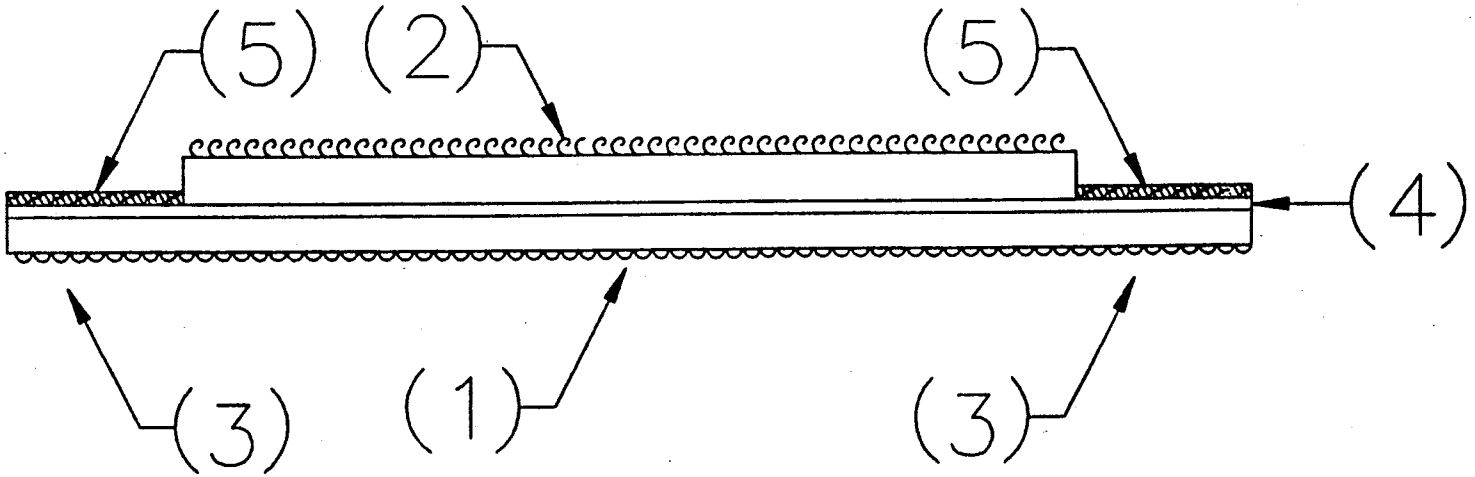
FIGS. 2A, 2B, and 2C illustrate a second embodiment of the invention.
Figure 2B:
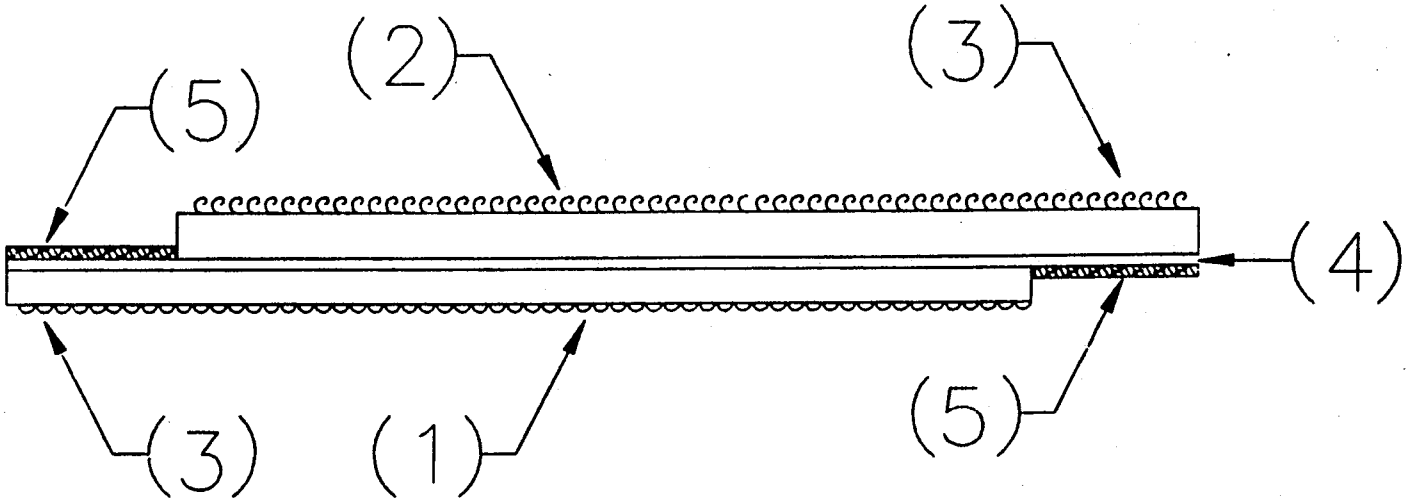
Figure 2C:
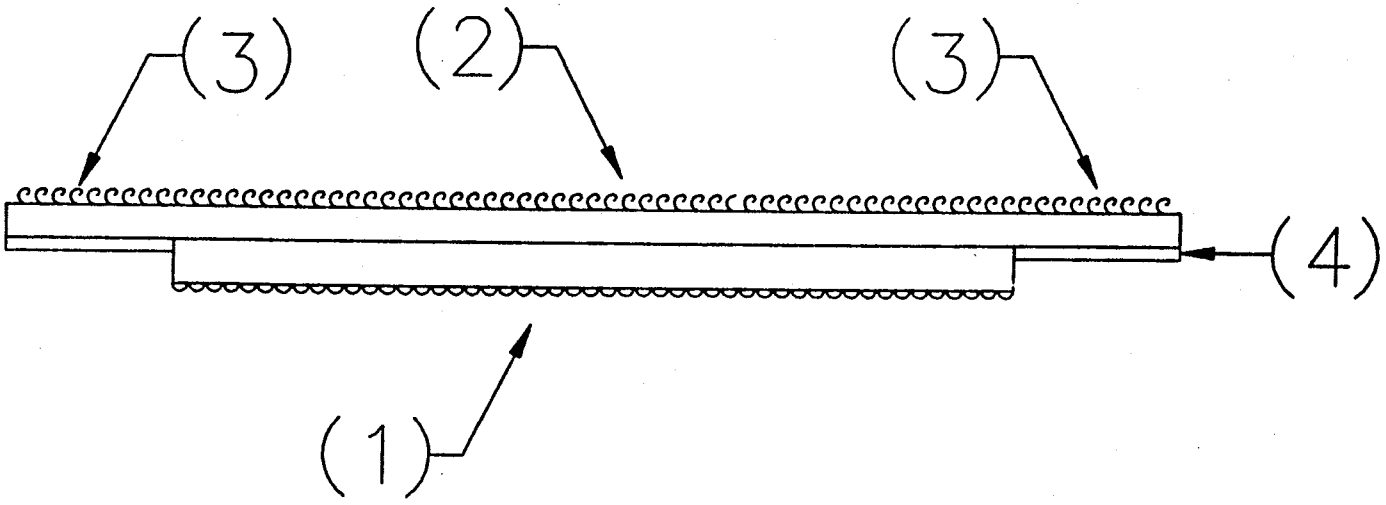

FIGS. 2A, 2B, and 2C show fasteners according to a second embodiment of the invention, consisting of one hook (2), and one loop(1) layer, permanently joined back to back, with both ends consisting of a single protruding layer(3). These single layer ends may consist of the loop layer (FIG. 2A), of the hook layer (FIG. 2C), or of one each of the hook and the loop layers (FIG. 2B). In all cases the protruding ends are provided with a pressure-sensitive, adhesive layer(4) on their back sides. FIG. 2C shows a fastener with adhesive layers(4) only on the protruding ends(3), the hook and loop layers of the main body having been joined by other means, such a sewing, heat-sealing, etc. In all the other cases, illustrated in FIGS. 1, 2A, and 2B, the adhesive layers cover the entire length of the fasteners and serve to join the hook and the loop layers. The ends serve to affix the fastener permanently to two objects. The objects can then be releasably and tightly secured to each other by winding the fastener so that the hook and loop surfaces adhere to each other. The fastener ends may be protected, before use, by strips of any suitable material(5), to be removed before fixing the fastener in place. FIG. 2C illustrates a fastener without such a protective strip.

Figure 3:
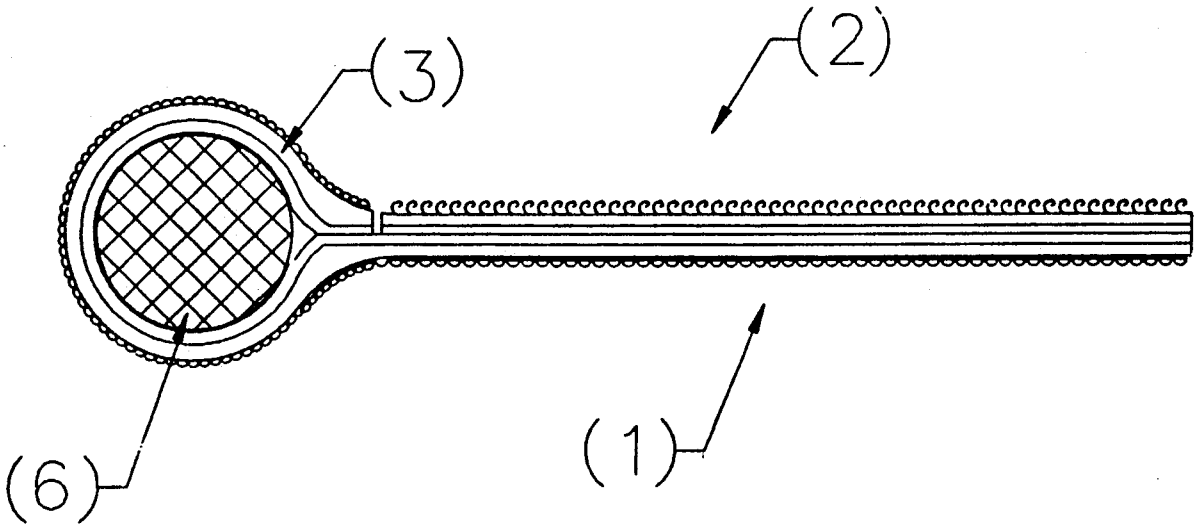
FIG. 3 illustrates the operation of a preferred embodiment of the invention of the type shown in FIG. 1, permanently affixed to an elongated object.

FIG. 3 shows a fastener of the preferred embodiment permanently affixed to an elongated object(6) so that it cannot slide out of position. The protruding, single-layered ends(3) with its adhesive surface has been wound around the elongated object, and in this example also extends from the object, and is attached to a portion of itself, having been cut to suitable length.

Figure 4:
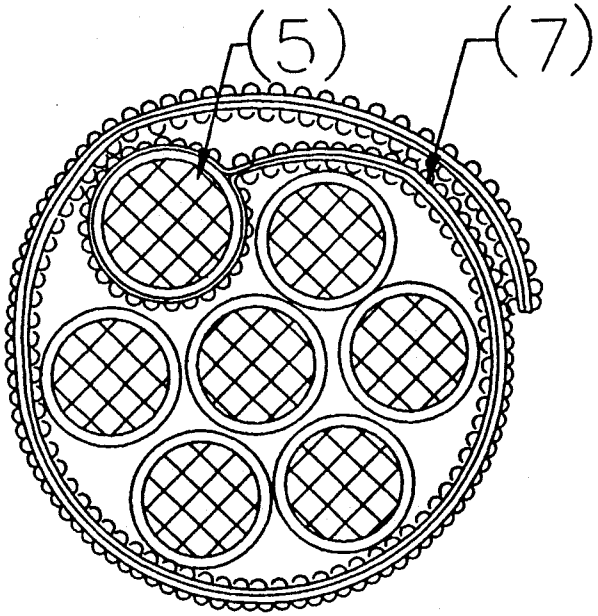
FIG. 4 illustrates the operation of a preferred embodiment of the invention, releasably securing a coiled bunch of an elongated object.

FIG. 4 shows a section the elongated object(6), of FIG. 3 rolled into a bundle and releasably secured by the fastener(7) wound around the bundle, with the hook and loop surfaces pressed together and adhering releasably.

Figure 5:
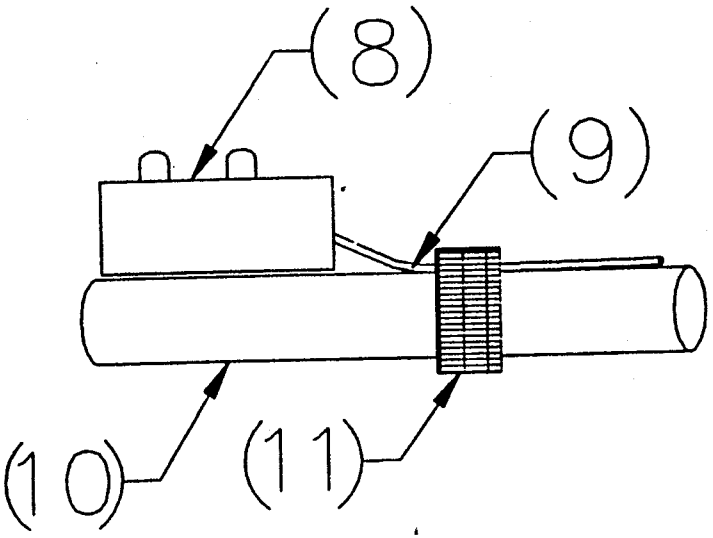
FIG. 5 illustrates the operation of a preferred embodiment of the invention, permanently affixed to an electric cord connected to a command module and releasably secured to a rail, bar, or other object.

FIG. 5 shows an example of use, in which a command module(8), is attached to a wire(9), to which a fastener(7) is permanently affixed. The fastener is, in turn, releasably secured to a rail, bar, column, or other object(10).

Figure 6:
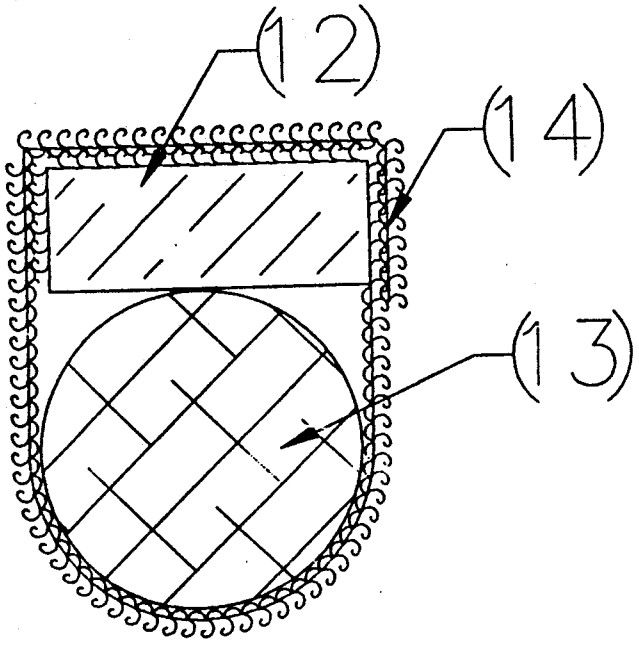
FIG. 6 illustrates the operation of a preferred embodiment of the invention, permanently affixed to one object, and releasably secured to another object.

FIG. 6 shows another example of use in which an object(11) of any suitable type, size, etc., with a fastener(7) permanently affixed, has been releasably secured to another object(12), likewise of any type or size, e.g. a bar, rod, etc.

Figure 7:
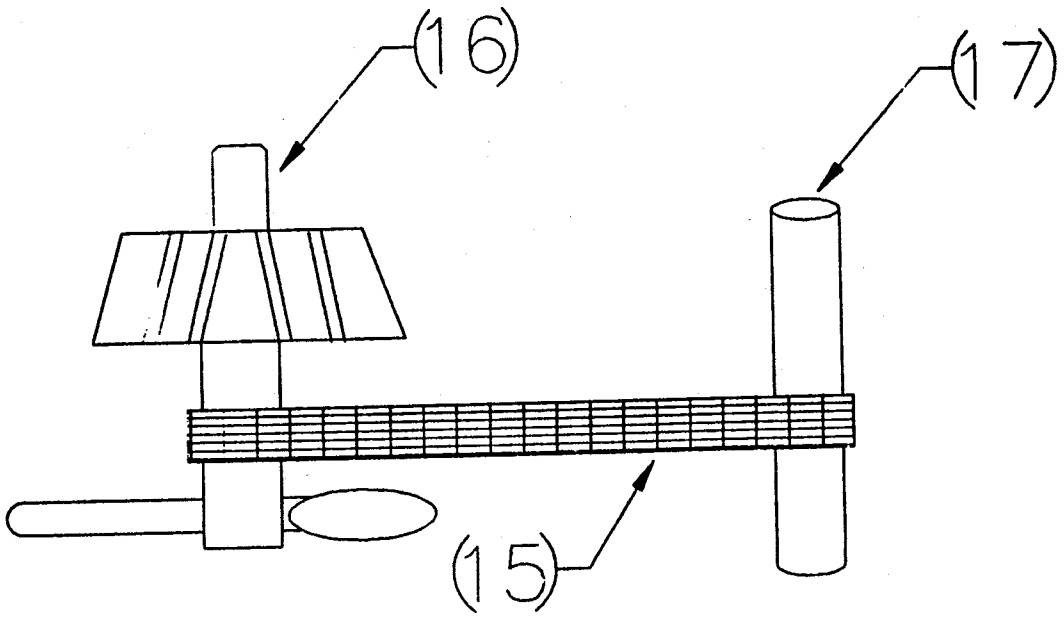
FIG. 7 illustrates the operation of a second embodiment of the invention of the types shown in FIGS. 2A, 2B, or 2C, permanently attaching two objects to each other.

FIG. 7 shows an example of use wherein a fastener of the second preferred embodiment(13) shown in FIGS. 2A, 2B, or 2C is permanently affixed to two objects, in this case to a chuck key(14), and to an electric hand drill, or to its wire cord(15). Like in the other examples, this particular use is given only for reasons of illustration.

Modifications and changes from the specific forms of the invention herein shown as typical examples will occur to those skilled in the art. All such modifications and changes, not departing from the spirit of the invention, are intended to be embraced within the scope of the appended claim.

What is claimed is:

1. Fastener consisting essentially of two elongated layers of hook and loop materials of different lengths, one layer of the hook type and one of the loop type, permanently joined together back-to-back to provide at least one protruding end, and with the at least one protruding end having a pressure-sensitive adhesive layer on the back side thereof serving to permanently affix the fastener to the object to be secured to another part of itself or to another object, by winding the fastener around the other parts of itself or other object so that the hook and loop surfaces are pressed together and adhere releasably.

* * * * *